United States Patent [19]

Turns et al.

[11] 4,256,547

[45] Mar. 17, 1981

[54] UNIVERSAL CHROMIC ACID ANODIZING METHOD

[75] Inventors: Earl W. Turns; Robert E. Forrester, Jr.; Arthur C. Porter, all of Fort Worth, Tex.

[73] Assignee: General Dynamics Corporation, Fort Worth, Tex.

[21] Appl. No.: 57,058

[22] Filed: Jul. 12, 1979

[51] Int. Cl.[3] ..... C25D 11/08; C25D 11/18

[52] U.S. Cl. ..... 204/35 N; 204/58

[58] Field of Search ..... 204/58, 35 N

[56] References Cited

U.S. PATENT DOCUMENTS

| | | | |
|---|---|---|---|
| 3,406,106 | 10/1968 | Garwood et al. | 204/58 |
| 4,090,929 | 5/1978 | Jannier et al. | 204/58 |

FOREIGN PATENT DOCUMENTS 1399797 4/1965 France .

*Primary Examiner*—R. L. Andrews
*Attorney, Agent, or Firm*—James C. Fails

[57] ABSTRACT

What is disclosed is an improvement in a method of anodizing aluminum alloy parts to meet predetermined specifications regarding salt spray corrosion resistance, fatigue failure resistance, paint adhesion and coating weights and including the steps of connecting the aluminum alloy parts to an anode of a direct current voltage source that is positive with respect to a cathode, immersing the aluminum part near the immersed cathode in an electrolyte comprising an aqueous solution of chromic acid; and carrying out the anodizing under a predetermined voltage differential for a predetermined time with the electrolyte at a predetermined temperature. The improvement comprises employing a differential voltage in the range of 15–25 volts direct current between the anode and cathode, maintaining the temperature of the electrolyte in the range of 85° F.–110° F. and carrying out the anodizing for a time interval in the range of 20–60 minutes.

In a preferred embodiment, the anodized aluminum parts are given a seal commensurate with the paint adhesion characteristic desired. For example, if a lesser degree of paint adhesion is desired, a hot water seal is employed; whereas if a higher degree of paint adhesion is desired a sodium dichromate seal is employed, or given the anodized aluminum part.

7 Claims, 11 Drawing Figures

EFFECTS OF 20 VOLT CHROMIC ACID ANODIZE ON THE AXIAL* FATIGUE LIFE OF 7475-T7351 ALUMINUM PLATE, R=0.1

*TENSION-TENSION

Fig. 1a
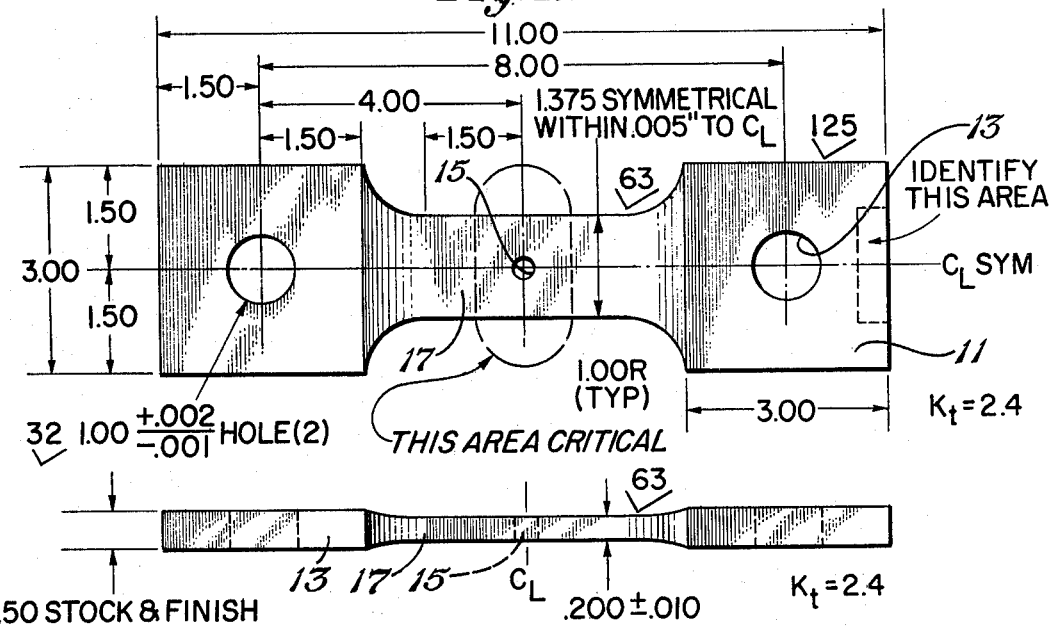
Fig. 1b
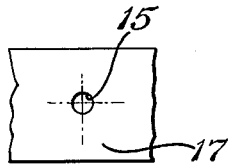
Fig. 1c
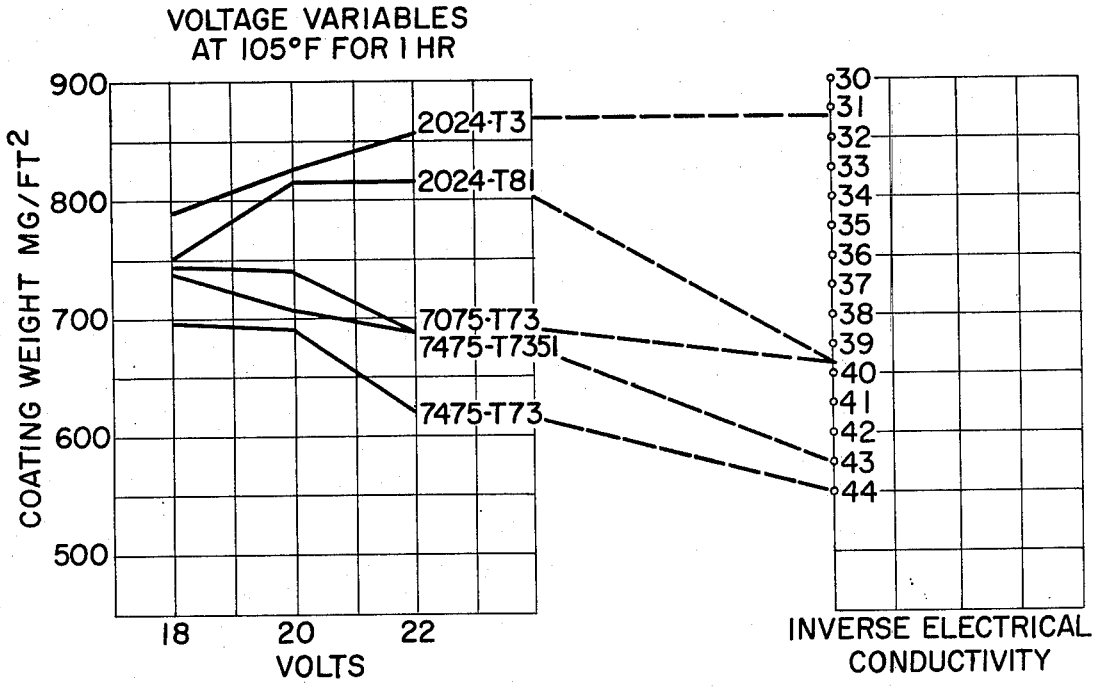
OTHER VOLTAGE VARIABLES AND THEIR RELATION TO ALLOY CONDUCTIVITY
Fig. 2

CHROMIC ACID ANODIZE - EFFECTS OF PROCESS VARIABLES ON BARE ALUMINUM ALLOYS · ANODIZE TIME 1 HOUR (ALL)

EFFECT OF WATER SEAL TIME ON SALT SPRAY CORROSION AND PAINT ADHESION

EFFECT OF SODIUM DICHROMATE SEAL ON SALT SPRAY CORROSION AND PAINT ADHESION

*LEGEND:*

——— 2024-T3 ○ SALT SPRAY FAILURE
— — — 7475-T73 □ PAINT ADHESION FAILURE
CHROMIC ACID ANODIZE AT 20 VOLTS

EFFECTS OF 20 VOLT CHROMIC ACID ANODIZE ON THE AXIAL* FATIGUE LIFE OF 7475-T7351 ALUMINUM PLATE, R=0.1

*TENSION-TENSION

UNIVERSAL CHROMIC ACID ANODIZING METHOD

This invention was made in the course of a contract (F33657-75-C-0310) with the Department of the Air Force.

FIELD OF THE INVENTION

This invention relates to the treatment of metallic parts to meet specifications. More particularly, this invention is concerned with anodizing of a wide variety of aluminum alloy parts to meet predetermined specifications regardless of the alloying constituents or quantity thereof, the specifications concerning salt spray corrosion resistance, fatigue failure resistance, paint adhesion and coating weights.

DESCRIPTION OF THE PRIOR ART

A wide variety of approaches have been taken to protect metal parts or otherwise insure that they meet specifications; for example, in aircraft manufacture and the like. With the increasing use of aluminum in the aircraft industry, it was first thought that the aluminum was an excellent metal that would minimize the need for treatment, since it tended to form an oxide coating that protected itself. Subsequent experiences showed, however, that it was more desirable to achieve controlled oxidizing, or anodizing with subsequent sealing of the coating, for additional corrosion protection, rather than relying upon the haphazard results attendant to ambient oxidization. The chromic acid anodizing process for corrosion protection of structural aluminum alloys was invented and subsequently patented by Bengough and Stuart in 1923. Their process utilized a complex voltage control procedure for time intervals applied to the aluminum alloys in a three percent (3%) by weight chromic acid aqueous solution operated at 100° F., the voltage centering about 40 volts. In 1937, Robert W. Buzzard at the National Bureau of Standards found that by increasing the chromic acid concentration to ten percent (10%) by weight, the complicated voltage variance cycle could be eliminated and the process time decreased.

About that time the United States Navy issued specifications (SR19c) requiring salt spray exposure of 30 days with subsequent tensile elongation losses of the treated aluminum alloys not to exceed ten percent (10%). Later, in 1941, a Government specification (AN-QQ-A-696) specified a 250 hour salt spray resistance for aluminum alloys containing less than five percent (5%) copper. This specification required 40 volt direct current (DC), 95° F., ten percent (10%) by weight chromic acid anodizing.

The Military Specification (MIL-A-8625) for all departments and agencies of the U.S. Department of Defense was first issued in 1954; it specified a 40 volt process. Change B (1969) to that specification dropped the 40 volt process requirement. At that time, the Military Specifications MIL-A-8625C, Amendment 1 specified the current chromic acid anodize requirements, which was a performance specification requiring certain performance in coating weight and salt spray corrosion resistance. Other desirable requirements include paint adhesion for certain structures that would be painted. Information on anodizing can also be found in Metals, Handbook, Volume 2, Eighth Edition, *Cleaning and Finishing of Aluminum Alloys,* p. 620-627, American Society of Metals, Metals Park, Ohio, 1964; in the *Journal of Research of the National Bureau of Standards,* Volume 18, U.S. Department of Commerce, R. W. Buzzard and J. H. Wilson, "Deterioration of Chromic Acid Baths for Anodic Oxidation of Aluminum Alloys," Washington, D.C., 1937 and *Aluminum Fabrication and Finishing,* Volume III, p. 656-658, American Society of Metals, Metals Park, Ohio. Summarizing, the chromic acid anodizing did not work satisfactorily for aluminum alloy with high concentrations of alloyed constituents; for example, over 5% copper or 7.5% total alloy contents.

The pragmatic consequences of all that was known about anodizing was that certain aluminum alloys having low percentage alloying elements; for example, those generally referred to as the 2000 series aluminum alloys were given one treatment with chromic acid at about 40 volts direct current potential; whereas other aluminum alloys having higher concentrations of additives, such as the 7000 series aluminum alloys, were often times sent out of the plant of government contractors to a specialist and given a sulfuric acid anodizing treatment. This added to the cost because the parts had to be maintained separately and tagged for separate anodizing processes.

Thus it can be seen that the prior art did not provide a universally acceptable chromic acid anodizing process that could be employed for all of the aluminum alloy parts that were to be anodized.

SUMMARY OF THE INVENTION

Accordingly, it is an object of this invention to provide a more nearly universal and improved process for anodizing aluminum parts regardless of the content of the aluminum alloy of which the parts are made, obviating the difficulties of the prior art.

It is a specific object of this invention to anodize aluminum alloy parts so they meet predetermined specifications regarding salt spray corrosion resistance of the sealed surface and superior paint adhesion without intolerable reduction in fatigue failure resistance; and which can be employed even for alloys containing over five percent (5%) copper or seven and one-half percent (7.5%) total alloying elements that heretofore required sulfuric acid anodizing, also effecting the object immediately hereinbefore.

These and other objects will become apparent from the descriptive matter hereinafter, particulary when taken in conjunction with the appended drawings.

In accordance with this invention there is provided an improvement in a method of anodizing aluminum alloy parts to meet predetermined specifications regarding salt spray corrosion resistance, improved fatigue life paint adhesion and coating weights and including the steps of connecting the aluminum alloy parts as an anode of a direct current voltage source that is positive with respect to a cathode, immersing the aluminum part in an electrolyte comprising an aqueous solution of chromic acid; and carrying out the anodizing under a predetermined voltage differential for a predetermined time with the electrolyte at a predetermined temperature. The improvement comprises employing a differential voltage in the range of 15-25 volts direct current between the anode and cathode, maintaining the temperature of the electrolyte in the range of 85° F.-110° F.; preferably in the range of 90° F.-105° F.; and carrying out the anodizing for a time interval in the range of 20-60 minutes.

In a preferred embodiment, the optimum conditions of about 20 volts, 95° F. and 45 minutes are employed for the anodizing.

In a particularly preferred embodiment the anodized aluminum parts are given a seal commensurate with the paint adhesion characteristic desired. For example, if a lesser degree of paint adhesion is desired, a hot water seal is employed; whereas if a higher degree of paint adhesion is desired, a sodium dichromate seal is employed, or given the anodized aluminum part.

BRIEF DESCRIPTION OF DRAWINGS

FIGS. 1*a*, 1*b* and 1*c* are respective front, side and enlarged details views of a fatigue test specimen employed in evaluating metal fatigue resistance of this invention compared to other anodizing methods and to bare specimens.

FIG. 2 is a plot of the coating weight in milligrams per square foot (mg/ft$^2$) as the ordinate against direct current volts for anodizing specific alloys at 105° F. for one hour; the inverse electrical conductivity being plotted at the right.

DESCRIPTION OF THE PREFERRED EMBODIMENTS

Figure 3:
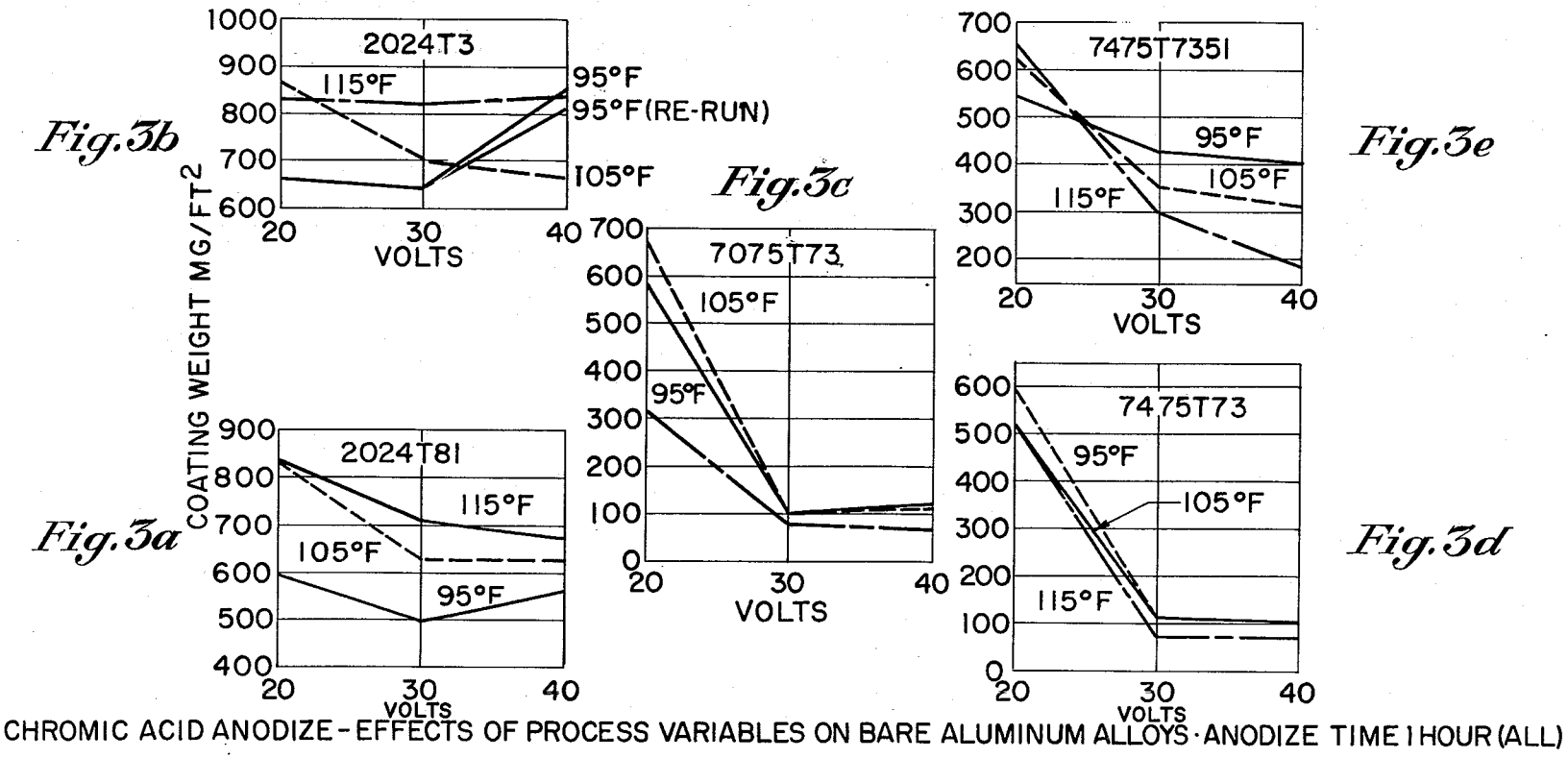
FIG. 3*a–e* are detailed plots of variations in anodizing voltages and temperatures and their effects on coating weights for respective aluminum alloys from the 2000 series and the 7000 series.

The process of anodizing can be found in published literature so it need not be discussed in great detail herein. A couple of the references have been referred to hereinbefore. In addition, it is in generally accepted standard references such as the Kirk-Othmer *ENCYCLOPEDIA OF CHEMICAL TECHNOLOGY,* Volume 1, Second Edition, A. Standen, Editor, Interscience Publishers, New York, New York, page 979. As noted therein, the aluminum is ordinarily subjected to an electrolytic process to first form an anhydrous coating of aluminum oxide ($Al_2O_3$). Subsquently, it is converted to boehmite (hydrated aluminum oxide) such that the coating loses its porosity. The usual type of electrolyte employed is sulfuric acid; although chromic acid was later introduced, as indicated hereinbefore. When the chromic acid was employed, however, it could not anodize satisfactorily the aluminum alloys with high alloying elements, such as the 7000 series as indicated hereinbefore. Thus the connecting of the aluminum parts to an anode of a direct current voltage source that is positive with respect to a cathode is part of the prior art. As is known, the aluminum part and the cathode are immersed in an electrolyte. In this invention, the electrolyte comprises an aqueous solution of chromic acid.

The chromic acid may contain from about three percent (3%) to as much as twenty percent (20%) chromic acid in water. The chromic acid does not appear to enter into the reaction, per se. It is preferable to sulfuric acid used in the early anodizing work. One of the problems with the anodizing of the aluminum alloys in the sulfuric acid anodizing was that there was too great a reduction in resistance to fatigue failure. Sulfuric acid anodize requires 600 mg/ft$^2$ to provide corrosion resistance equivalent to 200 mg/ft$^2$ for chromic acid anodize as stated in Mil-A-8625. For the high content aluminum alloys (high in concentration of alloying constituents) such as the 7000 series, it was deemed necessary to continue to use sulfuric acid anodizing (SAA). The electrolyte was changed to chromic acid, however, for the low content aluminum alloys on which it would work and the process referred to as chromic acid anodizing (CAA).

In this invention, widely divergent alloys of aluminum were chosen for investigation. It was technically sound to conclude that if a common environment and method could be developed to anodize satisfactorily all of the chosen alloys, it should be a universal process. Expressed otherwise, the developed method of anodizing works satisfactorily on any aluminum alloy part now anodized and used in aircraft structure and in a large commercial plant making the aluminum alloy structural parts for aircraft. Typical of the aluminum alloys chosen and on which the method of this invention works are the 2024, 7075, 7175 and the 7475. The nominal compositions of these aluminum alloys are given in standard reference sources, such as, *Aluminum Standards and Data,* Aluminum Association, Inc. 1976, 1978 N.Y., N.Y. 10017. For example, the nominal compositions for the 2024 and the 7075 are set forth in Table 1.1 at page 15 of the 1976 edition. To assist the reader nominal compositions, in terms of percentages (%) of alloying elements in aluminum, are set out in the following TABLE.

TABLE

| | Percentages by Weight | | | |
|---|---|---|---|---|
| Element | 2024 | 7075 | 7175 | 7475 |
| copper | 4.4 | 1.6 | 1.6 | 1.2–1.9 |
| magnesium | 1.5 | 2.5 | 2.5 | 1.9–2.6 |
| chromium | | 0.26 | 0.25 | 0.18–0.25 |
| zinc | | 5.6 | 5.6 | 5.2–6.2 |
| iron | | | | 0.12 max |
| silicon | | | | 0.10 max |
| manganese | 0.6 | | | 0.06 max |
| titanium | | | | 0.1 max 0.06 max |

While this invention is not to be limited to the consequences of any theory, it is theorized that the conductivity of the aluminum alloy was the controlling factor. Thus, by lowering the voltage with the chromic acid electrolyte, a more nearly uniform coating thickness could be achieved such that specifications could be met with all of the aluminum alloy series from the 2000 to the 7000 series. On the contrary, in the prior art, there was excessive voltage used with the anodizing, resulting in excessive oxygen production on the surface of the aluminum which caused polarization at the anode such that thin coatings resulted. In any event, it has been found that this invention works whether or not the theory is correct.

It has been found that a direct current electromotive differential between the anode and the electrode in the range of 15–25 volts could be employed. The optimum appeared to be about 20 volts. For example, as will be apparent from the descriptive matter regarding the experimental procedures hereinafter, 18 volts could be employed, particularly if the temperature was raised slightly or if the time of anodizing was increased.

In this invention, it is projected from the data that temperatures of from 85° F. to as much as 110° F. can be employed. Better results, in terms of shortening the time of anodizing and obtaining more nearly uniform coatings, are obtained if the temperature is maintained in the range of 90° F.–105° F. The optimum was found to be about 95° F. As is recognized 40° C. is about 105° F. As indicated hereinbefore, the temperature could be decreased toward 90° from the optimum if the voltage were increased or the time of anodizing increased. Conversely, the temperature could be increased above the optimum toward a 105° F. if the voltage were decreased or the time of anodizing decreased.

The anodizing time interval of from twenty minutes to as much as an hour or more can be employed, although the optimum is about forty five minutes. While even longer times can be employed there appears to be a wasting of the energy in effecting the longer anodizing. Moreover, there tended to be a reduction in fatigue failure resistance with longer time intervals. Similarly as described hereinbefore, the time could be decreased from forty five minutes toward the twenty minute range if the voltage were increased above the optimum or if the temperature were increased above the optimum. Conversely, if the time was increased more than the optimum toward the one hour limit, the voltage could be decreased below theo optimum or the temperature could be decreased below the optimum.

Once the anodizing was completed, the coating that would have been effected was rendered impermeable and nonporous by effecting a seal. If low paint adhesion were desired, the seal could be a hot water seal. On the contrary, if high paint adhesion were desired better results were obtained with the use of a sodium dichromate solution seal.

In the hot water seal, deionized water at a temperature of about 170° F. was employed for four minutes to effect the seal. The temperature range for the deionized water could be from 160° to as much as 180° and the time could be from two to eight minutes although the optimum was found to be a 170° F. for four minutes as indicated.

Where sodium dichromate seal was employed, a solution of an alkali metal dichromate such as sodium dichromate was employed. The concentration of the sodium dichromate could range from two to ten percent by weight with the optimum being about five percent by weight. The dichromate solution was maintained at a temperature of about 200° F. as the optimum although the temperatures could vary as much as ten to twelve degrees on either side. The time for effecting the seal was found to be optimally about ten minutes, although as little as four and as much as fifteen minutes or more could be employed.

While it is implied in the foregoing, it is assumed that the reader understands that the anodized aluminum part is immersed in the aqueous medium, such as the hot water or the hot sodium dichromate solution for the indicated time to effect the seal.

EXAMPLES

Many test examples were tried and illustrate the efficacy of this invention. The test examples were carried out on aluminum plate specimens such as illustrated in FIGS. 1*a* and 1*b*. In FIGS. 1*a–c* Kt is an empirical constant selected to be 2.4 from Peterson's curve. This value is believed to be typical for a hole in an aircraft structure. There are variations, of course, some having higher Kt numbers and some having lower Kt numbers. The detail is illustrated in FIG. 1*c*. As can be seen in FIGS. 1*a–c*, the specimens have a pulling area 11 with an aperture 13. The plate specimen is symmetrical about a center drilled aperture 15. As will be noted, the pulling areas 11 are somewhat thicker than the center section 17 and have greater width to insure that failure is effected along the center section 17. The apertures 13 may be of a predetermined size, such as one inch in diameter. The center drilled aperture 15 is then reamed to have a diameter in the region of the predetermined allowable; for example 0.375–0.380 inch diameter as shown in FIG. 1*c*.

The specimen fabrication age temperature verification identification and test distribution was carefully controlled. The specimens were cleaned and anodized in accordance with standard procedure. Specifically, they were degreased for ten minutes and then cleaned in a surfactant such as Emulkleen at a temperature of 125°–135° F. for ten minutes. Thereafter, they were given a cold water rinse. The specimens were then deoxidizied with either a chemical, such as Am-Chem 7–17, for four to six minutes or an acid solution for ten minutes, where the solution was nitric, hydrofluoric, and chromic acids. This was followed by two separate cold water rinses. Then the anodizing was carried out in the chromic acid solution of about ten ounces per gallon (normal strength).

The test variables were then carefully controlled with the voltages being varied between 18, 20, 22, 30 and 40 volts direct current. The temperatures of 95°, 105° and 115° were tried. The time was varied between 20, 35, 45, and 60 minutes. This was followed by a cold water rinse. Thereafter, the different seals were tried including deionized water; the chromic acid, 100 parts per million; Alodine 1200S; and the sodium dichromate solutions were tried. Only the hot water or sodium dichromate solutions were found to be acceptable seals.

Coating weights were determined before and after stripping weight loss differential as detailed in the Military Specifications MIL-A-8625C. Salt spray exposure was 336 hours in a 5% salt spray atmosphere with the specimens inclined at a six degree angle from vertical as specified. The pass or fail criterion was as specified in paragraph 3.10.1.2, "the specimen panels or finished products shall show no more than a total of 15 isolated spots or pits, none larger than 1/32 inch in diameter, in a total of 150 square inches of test area grouped from five or more test pieces; nor more than five isolated spots or pits, none larger than 1/32 inch in diameter, in a total of 30 square inches from one or more test pieces, except those areas in 1/16 inch from identification markings and electrode marks remaining after processing".

Paint adhesion test panels with the controlled variations in anodize process parameters received one coat of MIL-P-23377 epoxy primer or two coats of MIL-C-27725 fuel tank polyurethane coating to required thicknesses as specified. After the required paint cure period, paint adhesion specimens were soaked 24 hours in distilled water and scribed as specified in MIL-F-18264. An X-ACTO knife was used in scribing and #250 tape (3M Company, Saint Paul, Minnesota 55101) was used to apply adhesive stresses on the paint-to-anodize bond. Any microscopic (4X) evidence of loss of paint adhesion along the scribe lines was regarded as an adhesive failure of the paint system to the chromic acid anodize.

Metal fatigue (substrate) effects of the various selected anodize processes was determined. Substrates for the various chromic acid anodize coatings were bare aluminum alloy 7475–T7351.

The fatigue test specimens were tested on a BLH (Balwin-Lima-Hamilton Co., Philadelphia, Pa.) Model SF-10-U test machine. The R value (ratio of minimum to maximum loads) was 0.1 for the applied tension-tension fatigue loads. Triplicate specimens were run for each test variable. A standard four stress level fatigue curve was run with bare controls and 25 KSI was chosen as the most significant portion of the curve.

The specimens were prepared and had their temper verified and each specimen identified. The results of the many test examples are believed best shown by graphs.

FIG. 2 illustrates voltage varations of 18, 20 and 22 volts at 105° F. for one hour. Higher voltages produce more variance in the five alloy-temper combinations coating weights examined. The first part of the number designates alloy composition and the T+ following number designates the temper. As is recognized, temper connotes standard thermal and other physical treatment to obtain a desired strength level. In fact, as can be seen, the higher voltages actually decreased the coating weight of the overaged 7000 series alloys. The military specifications for anodizing states "alloys containing five percent (5%) copper and/or those containing 7.5% total alloy elements shall not be chromic acid anodized but sulfuric acid anodized instead". As can be seen in FIG. 2 that implication, translated into terms of electrical conductivity, indicated that the phenomenon was based on inverse conductivity. Related to conductivity of the aluminum alloy, whereby annealed copper is 100%, the overaged 7000 alloys are more conductive than the 2000 series; and the most conductive of the alloys, the 7475–T73, typically received less coating weight. The chromic acid serves principally as the electrolyte but small quantities are retained in the oxide film to additionally inhibit corrosion.

The synopsis of the test example variables and their effect is illustrated in FIGS. 3*a–e*. The graphs for the five principal alloy-temper combinations have voltage as the abscissa and the coating weights as the ordinate. Plots of three tank temperatures at three controlled voltages comprise the test data.

By the previous conventional system, which specified 40 volts at 95° for one hour, the high coating weights; for example, 550 and 850 miligrams per square foot for the 2024-T3 and 2024-T81 aluminum alloys are seen in the FIGS. 3*a–e*. Correspondingly, low coating weights for the 7000 series in the range of 90 to 400 miligrams per square foot are seen at 40 volts, and 95° F. The examination of all five alloy-temper combinations at 30 volts showed little change in coating weights, although a change to 20 volts anodizing potential has significant effects on coating weights. At 20 volts all coating weights were 300 milligrams per square foot or higher. By raising the temperature to 105° F. all coating weights were 525 milligrams per square foot or better. Although 20 volts substantially increased coating weight for the overaged 7000 series, the other alloys (2024-T3 and 2024-T81) coating weights were not increased appreciably. In essence the 20 volts system at 95° F. or 105° F. provides greatly improved coating weights of the overaged 7000 series alloy without undesirably increasing 2024 alloy coating weights. It thus appeared that the 20 volt, chromic acid system could provide a universal anodizing system that would be satisfactory for all a plant's aluminum alloy parts.

When the 20 volt data is extracted, at 95° F., there is generally lower but more nearly uniform coating weights. Expressed otherwise, there is less variance between five principal aluminum alloy-temper combinations tested. When the chromic acid anodizing process tank temperature was raised to 105°, heavier coating weights were effected but variance between alloys also increased although the approximate 250 milligrams per square foot differential between the minimum and maximum was not considered prohibitive. However, at 115° tank temperature unacceptable variance occurred and the 7075-T73 alloy coating weight had dropped to approximately 300 milligrams per square foot.

Figure 4:
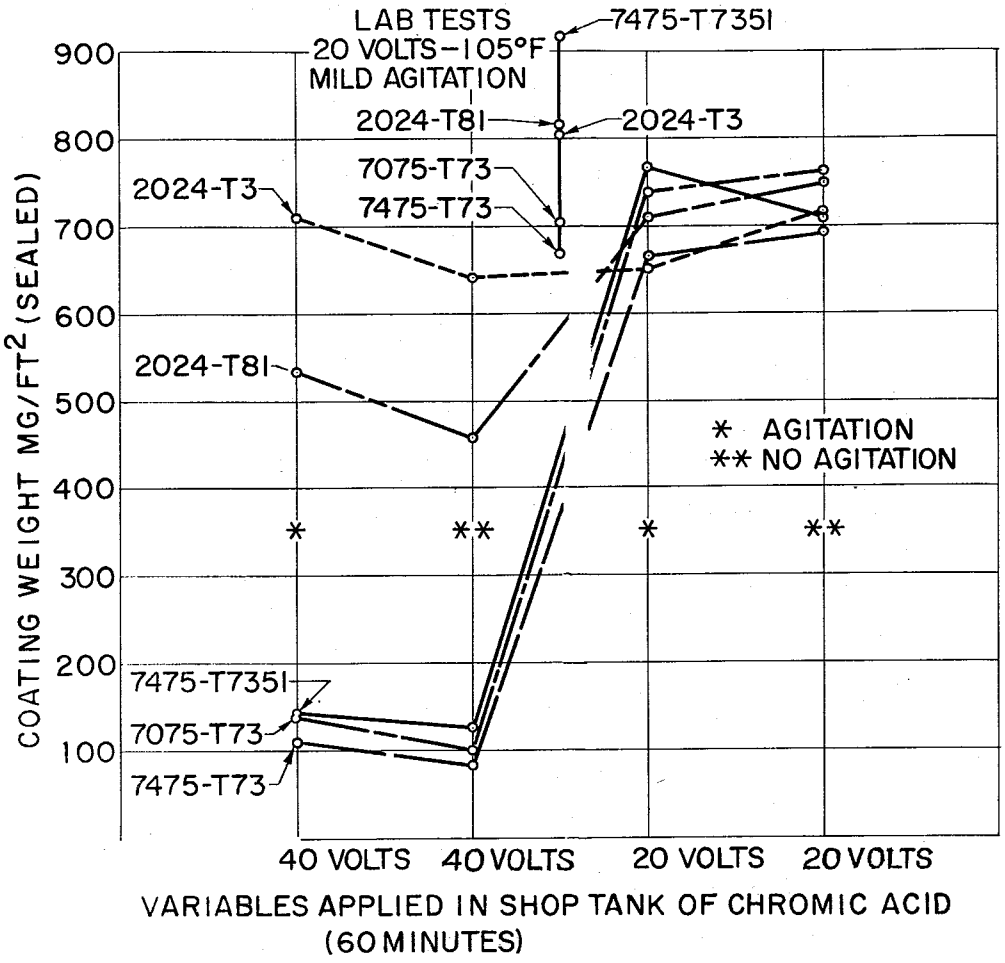
FIG. 4 is a graph of the coating weights of the respective aluminum alloys plotted against voltage for a full scale production tank prototype.

FIG. 4 is a graph plotting the effect when the chromic acid anodizing was moved from a small 40 gallon tank to a large 8,000 gallon tank. The wide variations in coating weights at 40 volts and the almost equivalent voltage weights at 20 volts provide a striking verification of the efficacy of this invention. It is noteworthy that all of the aluminum alloy-temper combinations from the 2000 series to the 7000 series come together at about 700 milligrams per square foot at 20 volts.

Figure 5:
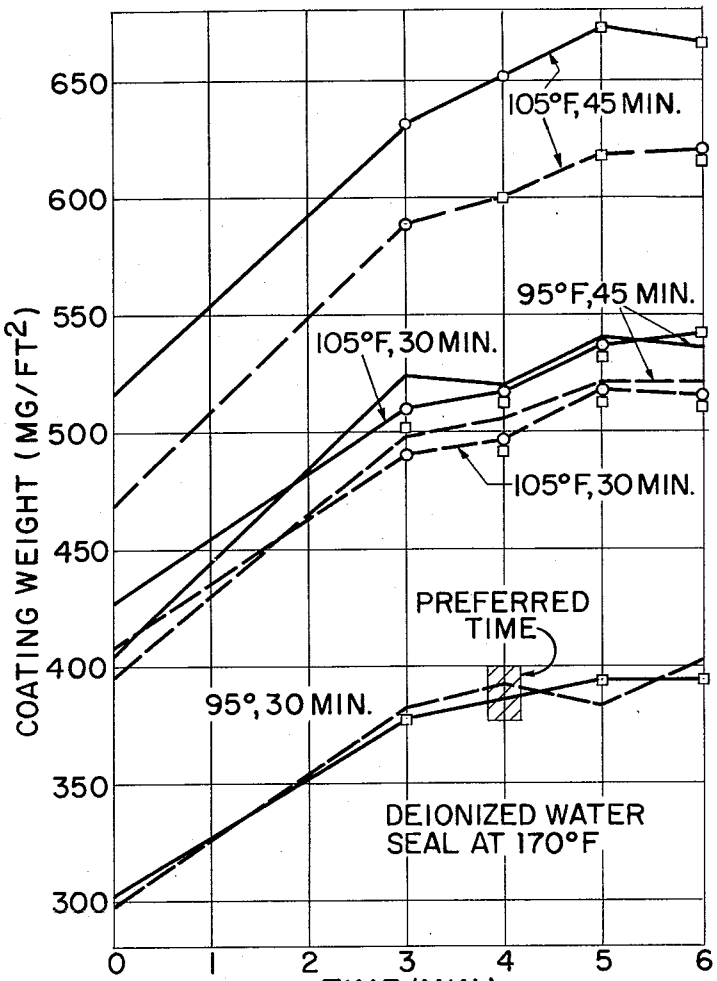
FIG. 5 is a plot of anodizing coating weights at various times and temperatures against the time in minutes for respective hot water seals at 170° F. and shows the points of failure of salt spray corrosion and paint adhesion.
Figure 6:
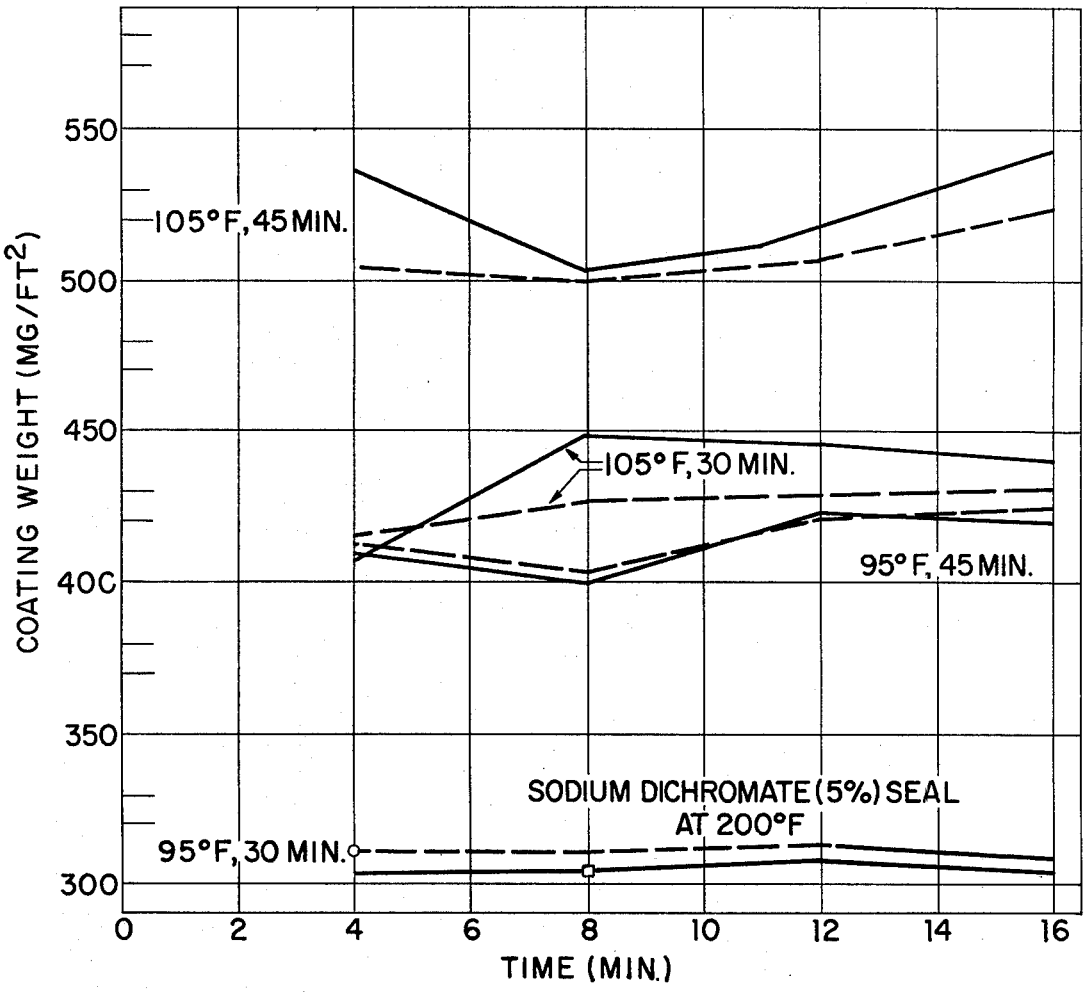
FIG. 6 is a plot similar to FIG. 5 and showing the coating weight as a function of time for sodium dichromatic seal at 200° F. Improved corrosion resistance and paint adhesion over the hot water seal (FIG. 5) were demonstrated.

FIG. 5 depicts the deionized water seal at 170° F. It shows by the closeness of the solid and dashed lines at specific temperatures the uniformity in coating weights effected in the 2024 aluminum alloy, solid line, and in the 7475 alloy, dashed line, at 20 volts. It also reveals failures in salt spray corrosion resistance and paint adhesion at the indicated failure points, the dot for the salt spray failure and the square for the paint adhesion failure on the respective elements. Essentially all of these seal inconsistencies that caused the failures are resolved with a sodium dichromate seal, as shown in FIG. 6. Coating weights produced by 95° F., forty five minute anodizing with a sodium dichromate seal had no paint or corrosion failures.

Figure 7:
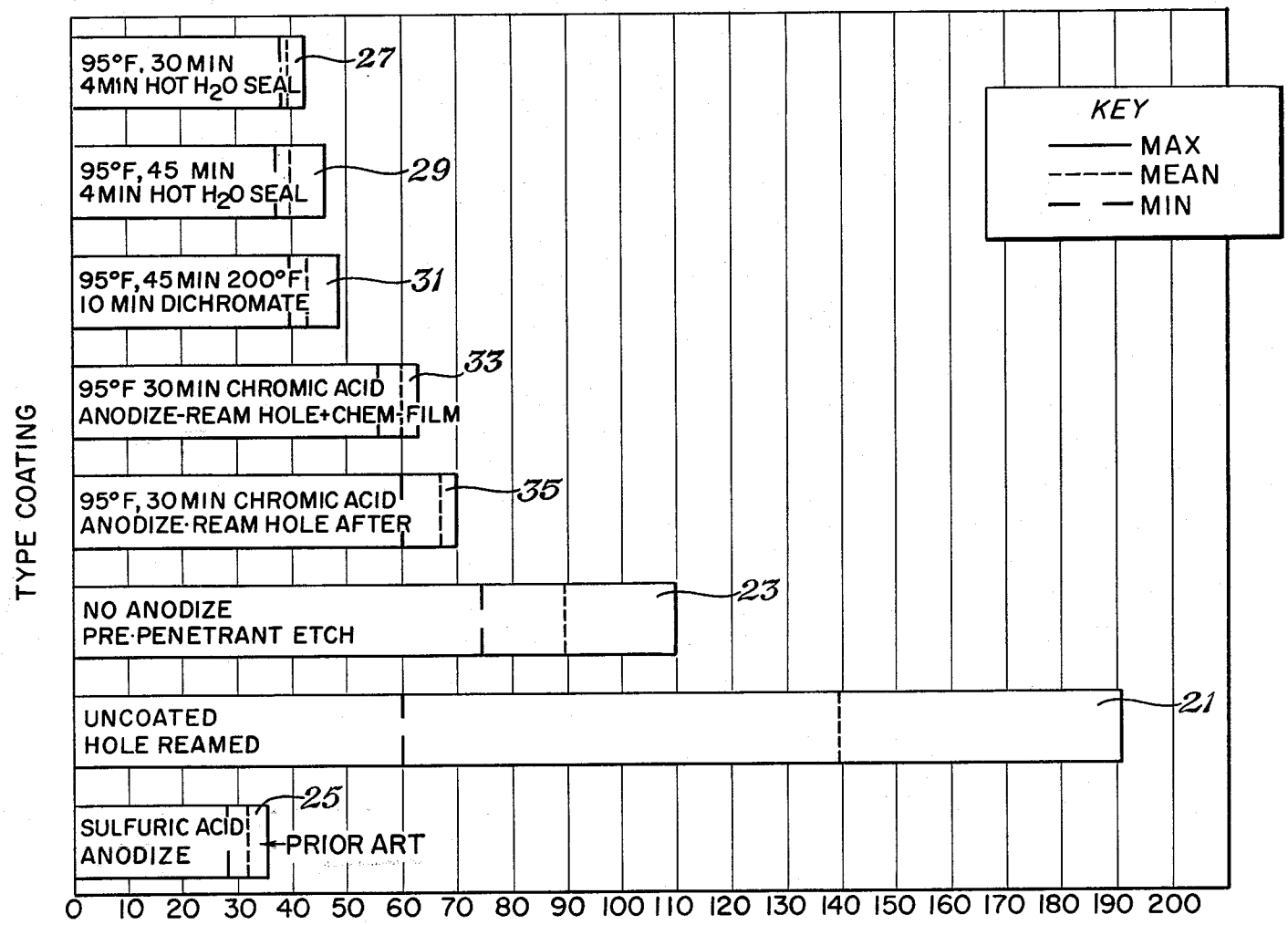
FIG. 7 shows the bar graph comparison of the type of coatings plotted against the effects on fatigue life in kilocycles (kc).

Another important feature of the 20 volt chromic acid anodizing system in accordance with this invention is revealed in FIG. 7. A significant improved fatigue endurance over the sulfuric acid anodizing is shown. The uncoated reamed hole is shown by the appropriate bar 21. Note that the fatigue life is reduced by a prepenetrant etch, shown in the bar 23. When the specimen is subjected to sulfuric acid anodizing, the fatigue life is dramatically reduced to about 1/6 or less of the uncoated, reamed hole and less than ⅓ of that of the prepenetrant etch bar without anodizing. The sulfuric acid anodizing is shown by bar 25 and is prior art. The bar 27 shows a 20 volt anodizing for thirty minutes at 95° F. followed by a four minute hot water seal. The bar 29 shows an improved result with increased resistance to fatigue failure, although not greatly improved, when the time is increased to forty five minutes. Still greater improvement is achieved, as shown by bar 31, when the sealing of the coating is carried out for ten minutes in a sodium dichromate solution (5% by weight, and 200° F.). The bar 33 shows improved results when the chromic acid anodizing is carried out for thirty minutes at 95° F. followed by anodized-reamed hole plus a chemical film. Bar 35 represents the fatigue life of a typical hole drilled in the aircraft structure after the detail parts have been anodized.

From the foregoing it can be seen that this invention provides a new and useful chromic acid anodizing process that is satisfactory for anodizing all aluminum alloy parts regardless of their alloying content. Expressed otherwise, this invention provides a standard process for anodizing aluminum parts and eliminates the necessity for segregating and dual processing; specifically eliminating the necessity of separate treatment of the aluminum alloys containing over five percent (5%) copper or over 7.5% alloy constituents as has been required in the prior art. Expressed otherwise, this invention allows application of an optimum voltage at an optimum temperature for an optimum period of time to provide a substantially equivalent coating weight for all aluminum alloys and thus provide a universal chromic acid anodizing process. In the preferred embodiments, this is augmented by a sodium dichromate seal that is unique in providing exceptionally high paint adhesion, as well as meeting all other specifications desired for aluminum alloy parts.

Having thus described the invention, it will be understood that such description has been given by way of illustration and example and not by way of limitation, reference for the latter purpose being had to the appended claims.

We claim:

1. In a method of anodizing aluminum alloy parts that include the steps of:

a. connecting the aluminum alloy parts as an anode of a direct current voltage source that is positive with respect to a cathode and has a differential voltage existing between said anode and said cathode;

b. immersing said aluminum part connected as said anode and said cathode in an electrolyte comprising an aqueous solution of chromic acid;

c. carrying out the anodizing for a predetermined time; and d. removing the anodized aluminum part from said electrolyte and said connection with said anode; the improvement comprising a standardized anodizing procedure that will be effective to meet predetermined specifications regarding salt spray corrosion resistance, fatigue failure resistance, paint adhesion, and coating weights, regardless of the type of aluminum alloy being employed, including alloys containing at least five percent (5%) copper and at least seven and one-half percent (7.5%) total alloying elements, comprising the steps of:

e. imposing as said differential voltage a direct current electromotive potential in the range of 15–25 volts between said anode and said cathode;

f. maintaining a temperature of said electrolyte and said aluminum part in the range of 90° F.–105° F.;

g. continuing said anodizing for a period in the range of 20–60 minutes;

such that a single process enables anodizing substantially any aluminum alloy parts in a plant making fabricated aluminum parts and the like and obtain anodizing to meet said predetermined specifications without having to have a plurality of processes for a plurality of different types of aluminum alloy.

2. The method of claim 1 wherein said aluminum alloy parts are formed from an aluminum alloy selected from the class consisting of 2024, 7075, 7175 and 7475.

3. The method of claim 2 wherein the anodized aluminum part is given a dichromate seal by being placed into an aqueous solution of alkali metal dichromate at a temperature in the range of 188°–212° F. for a time sufficient to afford a dichromate seal.

4. The method of claim 3 wherein said aqueous solution of an alkali metal dichromate is an aqueous solution of sodium dichromate and the temperature is about 200° F. for about ten minutes.

5. The method of claim 2 wherein said voltage differential is about twenty (20) volts, said temperature is about ninety five degrees F. (95° F.), and said time interval is about forty five minutes for said anodizing.

6. The method of claim 2 wherein there is an optimum voltage differential of about twenty (20) volts, and optimum temperature of about ninety five degrees F. (95° F.) and an optimum time of about forty five minutes and deviation of one of the process elements comprising said voltage differential, temperature and time below said optimum and above the minimum is accompanied by raising at least one of the other two of said process elements above said optimum and below said maximum of the respective ranges.

7. A method of claim 1 wherein said anodized aluminum part is given a hot water seal while being placed in deionized water at about 170° F. for about four minutes.

* * * * *